US007742032B2

(12) United States Patent
Diefenbaugh et al.

(10) Patent No.: US 7,742,032 B2
(45) Date of Patent: Jun. 22, 2010

(54) IMAGE ADAPTATION PHASE-IN

(75) Inventors: Paul S. Diefenbaugh, Beaverton, OR (US); David Wyatt, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 1452 days.

(21) Appl. No.: 11/026,669

(22) Filed: Dec. 31, 2004

(65) Prior Publication Data

US 2006/0146003 A1 Jul. 6, 2006

(51) Int. Cl.
*G09G 3/36* (2006.01)

(52) U.S. Cl. ..... 345/102; 345/690

(58) Field of Classification Search ..... 345/102, 345/690

See application file for complete search history.

(56) References Cited

U.S. PATENT DOCUMENTS 5,119,084 A * 6/1992 Kawamura et al. ..... 345/98
5,528,257 A * 6/1996 Okumura et al. ..... 345/99
5,786,801 A * 7/1998 Ichise ..... 345/102
5,952,992 A * 9/1999 Helms ..... 345/102
6,097,836 A * 8/2000 Inoue ..... 382/165
6,271,813 B1 * 8/2001 Palalau ..... 345/77
6,329,980 B1 * 12/2001 Uehara et al. ..... 345/204
6,483,245 B1 * 11/2002 Weindorf et al. ..... 315/82
6,693,612 B1 * 2/2004 Arakawa et al. ..... 345/87
6,750,837 B1 * 6/2004 Kondoh ..... 345/97
7,154,468 B2 * 12/2006 Linzmeier et al. ..... 345/102
7,205,973 B2 * 4/2007 Ma et al. ..... 345/102

* cited by examiner

*Primary Examiner*—Sumati Lefkowitz
*Assistant Examiner*—Grant D Sitta
(74) *Attorney, Agent, or Firm*—Robert A. Diehl

(57) ABSTRACT

Embodiments of the present invention can phase in image adaptations for display devices by determining a next incremental step among a plurality of incremental steps from an initial image state of a display device to a target image state, and then implementing the next incremental step.

25 Claims, 7 Drawing Sheets

IMAGE ADAPTATION PHASE-IN

FIELD OF THE INVENTION

The present invention relates to the field of displays. More specifically, the present invention relates to phasing-in adaptations to a display image.

BACKGROUND

There are a variety of "backlight-and-panel" displays. These displays often include one or more backlights behind a panel of tiny, electrically-controllable "shutters." These shutters can be implemented in a number of different ways using a variety of technologies. The shutters can form dots, or pixels, of light on a panel by passing light from the backlight(s). The amount of light passed by each dot can be controlled by "opening or closing" the respective shutter to varying degrees. Depending on the technology being used, the shutters may not mechanically open and close in a literal sense, but the shutters can nevertheless be electrically controlled to provide that effect. A panel may include many thousands of these shutters that can be individually controlled to collectively form images. The data that indicates which shutters to open and close, and to what extent, is referred to herein as "image data."

In a color display, each pixel in a panel usually includes a group of at least three shutters, and the backlight often provides a wide spectrum of light. Each shutter in a group of three may be filtered to pass a different color of light from the backlight. For example, one shutter may pass red light, one shutter may pass green light, and one shutter may pass blue light. In which case, by individually controlling the three shutters in a pixel, different amounts of red, blue, and green light can be mixed to provide a wide variety of colors.

Backlight-and-panel displays are commonly used in a variety of mobile electronic devices, such as notebook computers, personal data assistants, cell phones, and the like. Unfortunately, backlights tend to consume a relatively large amount of power and can substantially shorten the battery life of a typical mobile device. A number of techniques have been developed to dim backlights under various circumstances to save power and extend battery life. One of these techniques is sometimes referred to as backlight modulation (BLM) or backlight image adaptation (BIA), but will be referred to as display power saving technology (DPST) for purposes of this patent.

The image data for a display panel is usually generated based on the backlight brightness level, also called the backlight setting. For a particular set of image data and a particular backlight setting, a vast majority of the shutters in a panel may be less than fully open. DPST technology can take advantage of this situation to save power by reducing the backlight setting and adjusting the image data to maintain or approximate the same perceived brightness level. That is, DPST technology can turn down the backlight to save power and compensate for much of the reduction in the backlight setting by opening shutters to a greater extent. DPST can analyze various characteristics of an image on a display, such as color, contrast, brightness, etc., to determine how much to adjust the image data and how much to adjust the backlight setting.

BRIEF DESCRIPTION OF DRAWINGS

Examples of the present invention are illustrated in the accompanying drawings. The accompanying drawings, however, do not limit the scope of the present invention. Similar references in the drawings indicate similar elements.

DETAILED DESCRIPTION OF THE INVENTION

Figure 1:
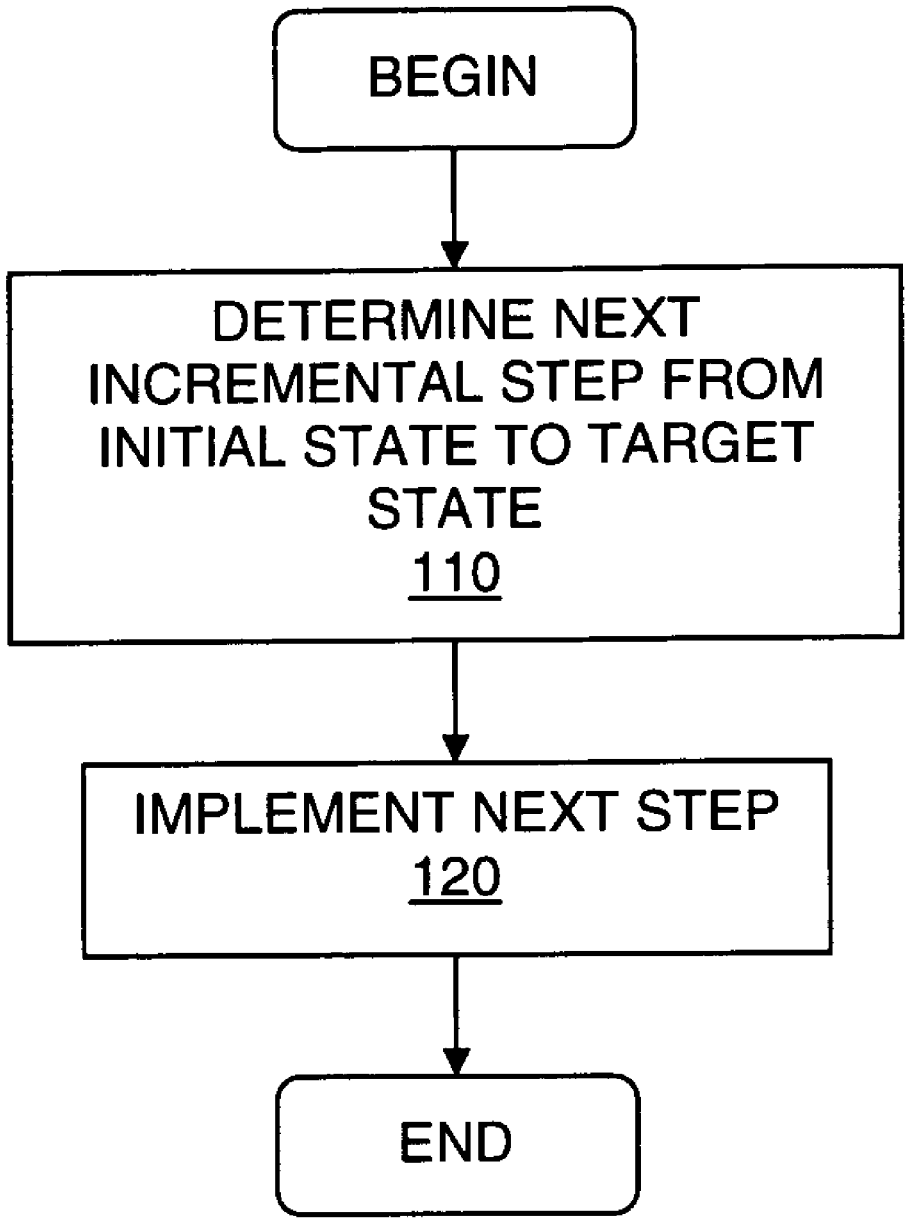
FIG. 1 illustrates one embodiment of the present invention at a high level.

In the following description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternative embodiments. In other instances, well known methods, procedures, components, and circuits have not been described in detail.

Parts of the description will be presented using terminology commonly employed by those skilled in the art to convey the substance of their work to others skilled in the art. Also, parts of the description will be presented in terms of operations performed through the execution of programming instructions. It is well understood by those skilled in the art that these operations often take the form of electrical, magnetic, or optical signals capable of being stored, transferred, combined, and otherwise manipulated through, for instance, electrical components.

Various operations will be described as multiple discrete steps performed in turn in a manner that is helpful for understanding the present invention. However, the order of description should not be construed as to imply that these operations are necessarily performed in the order they are presented, nor even order dependent. Lastly, repeated usage of the phrase "in one embodiment" does not necessarily refer to the same embodiment, although it may.

Embodiments of the present invention can phase-in adjustments to image data and backlight settings in a variety of circumstances to, for instance, improve display power saving technology (DPST) image quality and/or power savings, as well as provide new and useful applications for DPST technology.

For example, although DPST technology is generally quite good at maintaining colors when manipulating image data, many users can still perceive a change in brightness when a relatively large backlight adjustment is made. When many of these relatively large backlight adjustments are made in rapid succession, as can sometimes occur in action scenes in movies for instance, the image may appear to flicker. Embodiments of the present invention can reduce or eliminate this flicker effect by phasing-in adjustments to image data and backlight settings in small enough increments so that brightness changes are imperceptible or less perceptible.

In another example, embodiments of the present invention can phase-in adjustments to image data and backlight settings as a sort of pre-screen saver. Many notebook computers have a screen saver mode that turns off the display to save power after some period of inactivity. The period of inactivity is usually fairly long, often 15 or even 30 minutes, because many users find it quite frustrating to have their display turn off while they are, in fact, still viewing it. Some computers can dim the backlight gradually so as to be less intrusive and start saving power earlier, but embodiments of the present invention can be even less intrusive and save even more power by combining adjustments to image data with backlight dimming. That is, with embodiments of the present invention, the image can remain readable longer, allowing a pre-screen saver mode to start even earlier.

A particular backlight setting and corresponding set of image data will be referred to herein as an "image state." The "current image state" (or simply "current state") refers to the image state at a particular instant in time. DPST technology can trigger a change of image state, and this change will be referred to herein as an "image adjustment". An image adjustment is said to go from the "initial image state" (or simply "initial state"), which is the current image state when an image adjustment is triggered, and proceeds to a "target image state" (or simply "target state"), which is the image state requested by the DPST.

Embodiments of the present innovation can phase-in the image adjustment from the current state to the target state over time so as to preserve image quality, save power, control perceived brightness, or meet other goals. The phase-in process can decompose an image adjustment into "incremental steps", which are slight changes in image state. As the incremental steps are applied over time, the image state changes gradually from the image adjustment's initial state to the image adjustment's target state.

Because an image adjustment can occur over time, the DPST may determine a new preferred image state before an existing image adjustment has reached the target state. When the DPST triggers an image adjustment, the target state may be called a "new target state" so as to avoid confusion with any previous, and now-outdated, target state. Incremental steps may be calculated to achieve the new target state.

The "default" backlight setting for a display, as used herein, is what the backlight brightness level would be in the absence of DPST technology. The default backlight setting is often fairly constant in many electronic devices. In certain notebook computers, for instance, the default backlight setting may only change when a user manually adjusts the display brightness or when the computer recognizes some kind of event, such as a switch to battery power or a change in the ambient environment. The combination of the default backlight setting and the corresponding set of image data defines what is referred to herein as the "reference brightness level." That is, the reference brightness level indicates how bright an image on a panel should ideally appear following an image adjustment.

FIG. 1 demonstrates one embodiment of the present invention at a high level. In order to phase-in an image adjustment from an initial state to a target state, the illustrated process can determine a next incremental step from the initial state toward the target state at 110. Then, at 120, the process can implement the next incremental step. These two basic functions can be implemented in a wide variety of ways to phase in image adjustments, some examples of which are described below.

Figure 2:
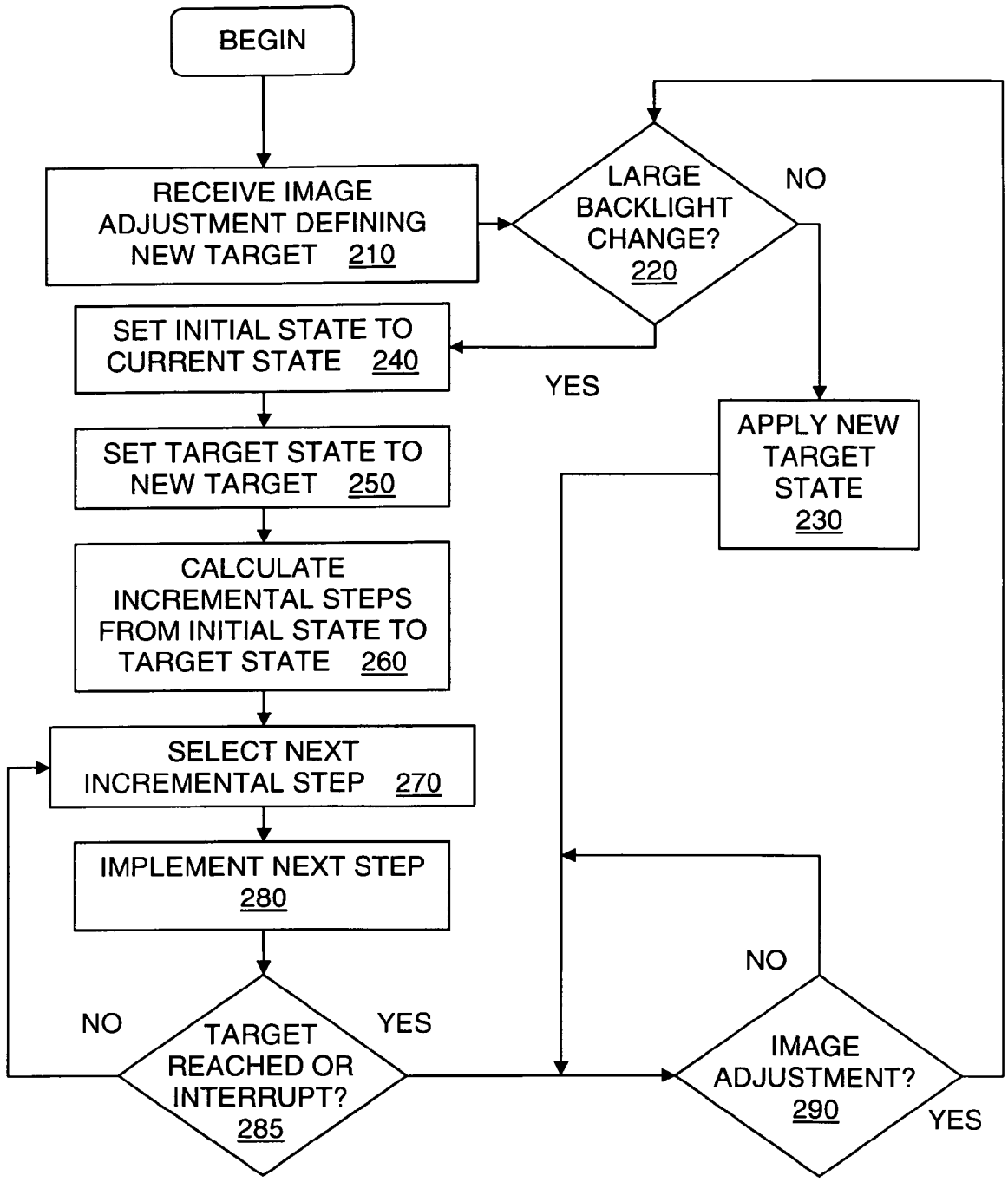
FIG. 2 illustrates one embodiment of the present invention in more detail.

FIG. 2 demonstrates an embodiment of the present invention in more detail. At 210, the process can receive an image adjustment defining a new target state. Any of a number of DPST techniques could be used to determine when to make an image adjustment. For example, some DPST technologies can trigger an image adjustment whenever there is a meaningful change in the image being displayed.

Rather than jumping directly to the new target state, however, the illustrated process can first check to determine if the change in the backlight setting between the current state and the target state exceeds a threshold at 220. For example, the threshold could be a maximum backlight change that a typical user is likely to notice. Other embodiments may use other threshold criteria.

If the threshold is not exceeded at 220, the process can apply the new target state to the display at 230. Once the target state is applied to the display, the process can check for another image adjustment at 290, and loop back to 220 when and if another image adjustment occurs.

If the threshold is exceeded at 220, the process can initiate a phase-in procedure by setting the initial state to the current state at 240 and setting the target state to the new target state defined by the image adjustment at 250. Then, at 260, the process can calculate incremental steps from the initial state to the target state. The incremental steps can be calculated in a number of different ways. In one embodiment, the incremental steps can be calculated so that a typical user is unlikely to notice a change in brightness from one step to the next.

Each incremental step can include a change in backlight brightness and a corresponding adjustment to the image data. The size of each incremental step (the amount of backlight change and image data adjustment) may not be linear in all respects. For example, a backlight setting is often based on a particular voltage level applied to the backlight. Equal changes in the backlight voltage may not provide correspondingly equal changes in the perceived brightness of the backlight in all circumstances. For instance, perceived brightness changes tend to be larger near the middle of the operating voltage range for many backlights, and smaller near the ends. In other words, the response curve for many backlights tends to be steeper near the middle of the operating range. Displays can also introduce various non-linear characteristics. For instance, image data often represents voltage levels applied to individual "shutters" in a panel. A change in perceived brightness for a given change in image data may be different depending on where the change is made in the display's operating range.

So, in certain embodiments, incremental steps may be linear in terms of perceived brightness changes, but non-linear in terms of the voltage steps applied to a backlight or display. In other embodiments, increment sizes may be linear in terms of voltage steps, but non-linear in terms of changes in perceived brightness. In still other embodiments, increment sizes may not be linear in any respect.

Examples of various incremental step calculations are described below with respect to FIGS. 3 and 4.

Once the incremental steps are calculated, the illustrated process can select a next incremental step at 270. The next incremental step is an element of the set of incremental steps calculated at 260, and represents the next change in backlight brightness and corresponding adjustment to the image data which can be applied as the next step from the current backlight brightness toward the target backlight brightness.

The illustrated process then applies the next incremental step at 280. The incremental steps can be applied in a variety of different ways. One example is described below with respect to FIG. 5.

Continuing with FIG. 2, at 285, the process can check if the target state has been reached or if an interrupt has been received. An interrupt may occur if, for instance, another meaningful change has been detected in the image being displayed, triggering a new image adjustment.

If an interrupt is not received at 285, the process can loop through 270, 280, and 285 to select and implement incremental steps until the target state is received. Once the target state is reached at 285, the process can wait for another image adjustment at 290. When and if a new image adjustment occurs at 290, the process can loop back to 220 to start again.

If an interrupt is detected at any iteration through 285, the process can move on to 290 before the target state is reached. If the interrupt is due to a new image adjustment at 290, and the new image adjustment includes a sufficiently large backlight change at 220, the process can loop back to 240 and 250 to re-initiate the phase-in process starting from the state at which the last iteration left off and progressing toward the new target state.

Alternate embodiments may not include the threshold check at 220. In which case, such embodiments could calculate incremental steps for all image adjustments. For image adjustments with relatively small backlight changes, the number of incremental steps may be small or just one.

Figure 3:
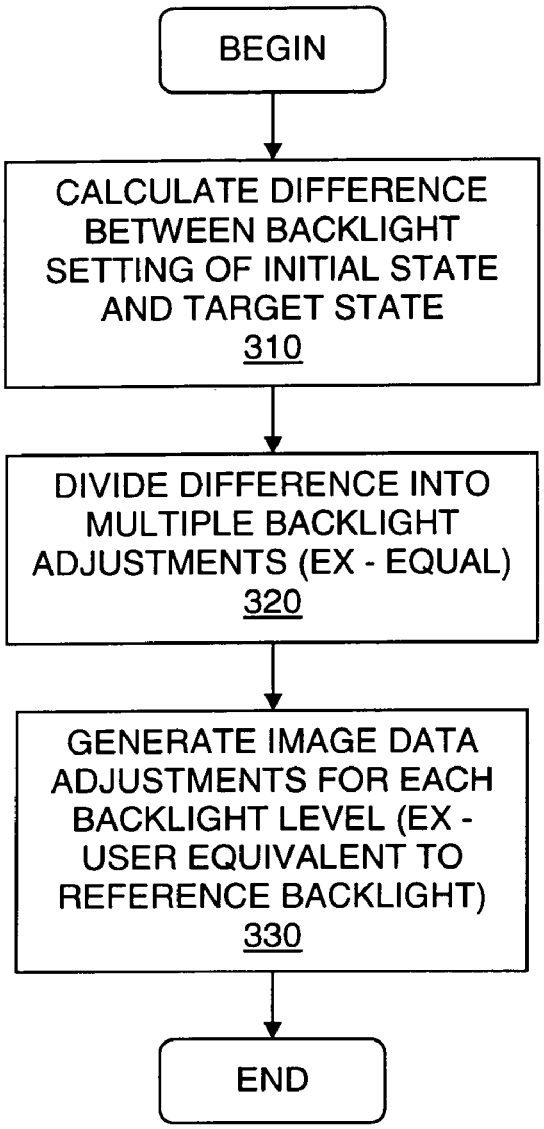
FIG. 3 illustrates one embodiment of the present invention for calculating a set of incremental image adjustments.

FIG. 3 demonstrates one embodiment of the present invention for calculating incremental steps for phasing-in an image adjustment. The illustrated process could be used, for example, to calculate the incremental steps at 260 in FIG. 2.

At 310, the process can start by calculating the difference between the backlight settings of the initial state and the target state. For example, if the default backlight setting is 150 nits, the backlight is currently at 90 nits, and the backlight setting for the target state is 80 nits, the backlight difference would be a decrease of 10 nits. On the other hand, if the backlight is currently at 20 nits, and the backlight setting for the target state is 35 nits, the backlight difference would be an increase of 15 nits.

At 320, the process can divide the backlight difference into a set of incremental steps which, when applied over time, change the backlight gradually from the original state to the target state. For example, in one embodiment, the process could divide the backlight difference into equal increments. The size and number of the increments can be determined in any number of ways. In one embodiment, assuming most users cannot perceive a backlight change at or below 1% of the current backlight setting, a backlight difference could be divided into 1% increments. For example, if the backlight setting is currently at 100 nits and the backlight setting for the target state is 112 nits, the backlight difference would be 12 nits, or 12% of the current backlight setting. In which case, the backlight difference could be divided into 12 increments of 1 nit, or 1%, each. Another example is described below with respect to FIG. 4.

Continuing with FIG. 3, at 330, the process can then generate a set of image data adjustments for each of the backlight increments. Generating image data adjustments, or gamma corrections, based on a backlight setting can be done in any of a number of different ways. Many of these techniques are designed to maintain or approximate a user equivalent experience with respect to the reference brightness level, as if no image adjustment had been applied.

In an alternate embodiment, rather than generating image data adjustments for every backlight increment all at once, the adjustments could be generated as they are needed. For instance, referring to FIG. 2, the process could simply calculate the backlight increments at 260. Then, the process could generate the image data adjustments between 270 and 280 during each iteration of the loop. In yet another embodiment, both the backlight increments and the image data adjustments could be calculated as they are needed. For instance, referring to FIG. 2, function 260 could be removed, and an incremental generation function could be included between 270 and 280. Where the phase-in process can be interrupted, as is the case in FIG. 2, it may be more efficient to generate all or some of the incremental data as the data is needed since some of the incremental data may not be needed.

Figure 4:
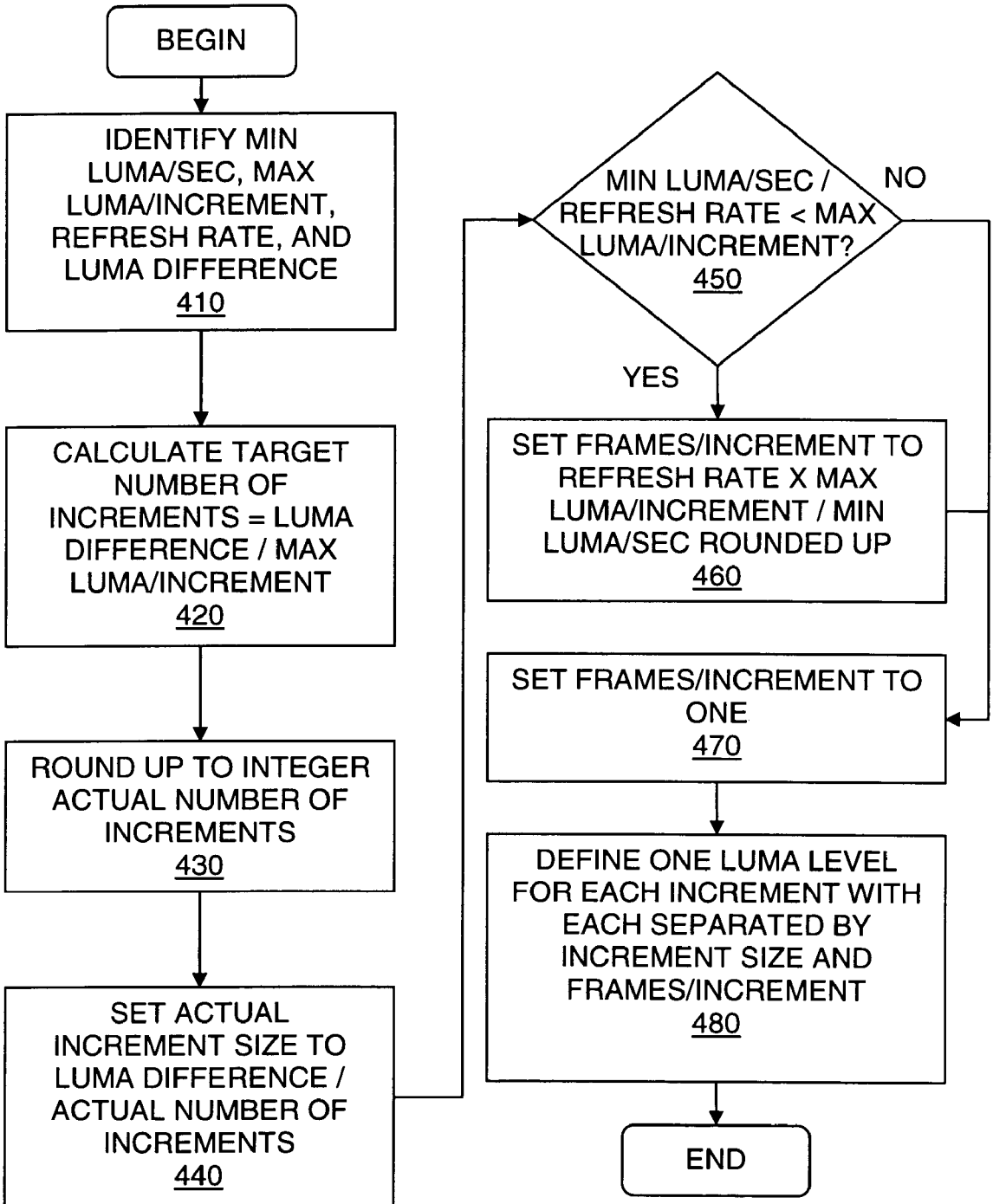
FIG. 4 illustrates one embodiment of the present invention for dividing a backlight setting difference into multiple incremental adjustments.

FIG. 4 demonstrates one embodiment of the present invention for calculating the size and number of incremental adjustments between a current state and a target state. For example, the process of FIG. 4 could be used at function 320 in FIG. 3.

The process of FIG. 4 attempts to find the smallest integer number of steps between the luma of the current state and the luma of the target state that will satisfy two constraints, maximum change in luma per increment ($\Delta L/inc_{MAX}$) and minimum change in luma per second ($\Delta L/sec_{MIN}$). "Luma" refers to a human-perceived brightness level of an image on a display, and takes into consideration both image data and backlight setting. The first constraint, $\Delta L/inc_{MAX}$, specifies the maximum amount that luma can be changed in one increment without being unduly noticeable. The second constraint, $\Delta L/sec_{MIN}$, specifies how quickly luma can be changed over time without being unduly noticeable. That is, the second constraint can be used to determine the minimum amount of time that a particular change in luma should take. Of course, these constraints can be set differently depending on what degree of noticeability is acceptable in a particular situation.

At 410, the process can identify the $\Delta L/inc_{MAX}$, the $\Delta L/sec_{MIN}$, and the refresh rate of the display in question (how often the image data can be updated), as well as the luma difference ($L_{diff}$) between the initial state and the target state. The refresh rate is usually specified in frames per second (F/sec). At 420, the process can calculate a target number of increments ($I_{tar}$) as:

$$I_{tar}=L_{diff}/\Delta L/inc_{MAX}.$$

By dividing the luma difference, $L_{diff}$, by the maximum increment size constraint, $\Delta L/inc_{MAX}$, this equation provides the fewest number of, and the largest possible, increments that meet the first constraint. Of course, the result may not be an integer, so the process can round $I_{tar}$ up to an integer to get an actual number of increments ($I_{act}$) at 430. In order to achieve the same luma difference after the number of increments is rounded up, the increment size can be reduced slightly from the maximum. So, at 440, the process can set an actual increment size (S) as:

$$S=L_{diff}/I_{act}.$$

At 450, the process can determine if the maximum increment size, $\Delta L/inc_{MAX}$, can be used in every frame without violating the second constraint, $\Delta L/sec_{MIN}$. The process can make this determination using a comparison:

$$(\Delta L/sec_{MIN}/F/sec)<\Delta L/inc_{MAX}.$$

The right side of the comparison is the maximum increment size constraint, $\Delta L/inc_{MAX}$. The left side of the comparison divides the minimum rate constraint, $\Delta L/sec_{MIN}$, by the refresh rate. This indicates what the increment size per frame would be at the maximum allowed rate of luma change. That is, if a larger increment size were used in every frame, the minimum rate constraint would be exceeded.

If the increment size on the left side of the comparison is larger than the increment size on the right side, then the maximum increment size, $\Delta L/inc_{MAX}$, can be used in every frame without exceeding the minimum rate constraint, $\Delta L/sec_{MIN}$. In which case, the process can set the number of frames per increment ($F_{inc}$) to one at 470.

If, on the other hand, the increment size on the left side of the comparison is smaller than the increment size on the right side, then the maximum increment size, $\Delta L/inc_{MAX}$, cannot be used in every frame without exceeding the minimum rate constraint, $\Delta L/sec_{MIN}$. The luma would change too quickly over time. In which case, a smaller increment size could be used in every frame, or the maximum increment size could be used in less than every frame.

Since the illustrated embodiment attempts to find the smallest integer number of steps between the luma of the current state and the luma of the target state, it uses the latter approach. Specifically, at 460, the process can set the frames per increment ($F_{inc}$) as:

$$F_{inc}=F/\sec(\Delta L/inc_{MAX}/\Delta L/sec_{MIN}),\text{ rounded up to the next integer.}$$

This equation is equivalent to dividing maximum number of increments in the minimum time allowed for the luma change, F/sec ($L_{diff}/\Delta L/sec_{MIN}$), by the actual number of increments, $I_{act}$.

Then, at 480, the process can proceed to define the incremental image adjustments using the actual number of increments ($I_{act}$), the increment size (S), and the frames per increment (F/inc). For example, in order to dim a backlight, the process can define $I_{act}$ increments, with each increment S luma less than the previous $F_{inc}$ frames. In order to increase a backlight, the process can define $I_{act}$ increments, with each increment S luma more than the previous increment starting with the initial state, and with each increment separated in time by $F_{inc}$ frames.

For example, using the process of FIG. 4, and assuming that $L_{diff}$ is 75 luma, $\Delta L/sec_{MIN}$ is 10 luma per second, $\Delta L/inc_{MAX}$ 2 luma per increment, and the refresh rate is 60 frames per second:

$$I_{tar}=75L/2L/\text{inc}=37.5\text{ increment,}$$

$$I_{act}=38\text{ increments, and}$$

$$S=75L/38\text{ inc}=1.97\text{ luma per increment.}$$

Evaluating the comparison:

$$(1L/\sec/60F/\sec=0.1667\text{ luma per frame})<2\text{ luma per increment.}$$

Since the left side of the comparison is less than the right, then the maximum increment size, $\Delta L/inc_{MAX}$, can be used at less than every frame. The frames per increment would be:

$$F_{inc}=60F/\sec(2L/\text{inc}/10L/\sec)=12\text{ frames per increment.}$$

In which case, in this example, there would be 38 increments with each increment separated by 1.97 luma and 12 frames. The total time (T) to phase-in the adjustments would be:

$$T=(38\text{ inc}\times 12\text{ frames/inc})/60\text{ frames/sec}=7.6\text{ seconds.}$$

The values used in this example were selected purely for purposes of explanation. Real world situations may involve entirely different values. Furthermore, alternate embodiments can use different sets of equations and constraints to calculate the size, number, and separation of incremental image adjustments.

Figure 5:
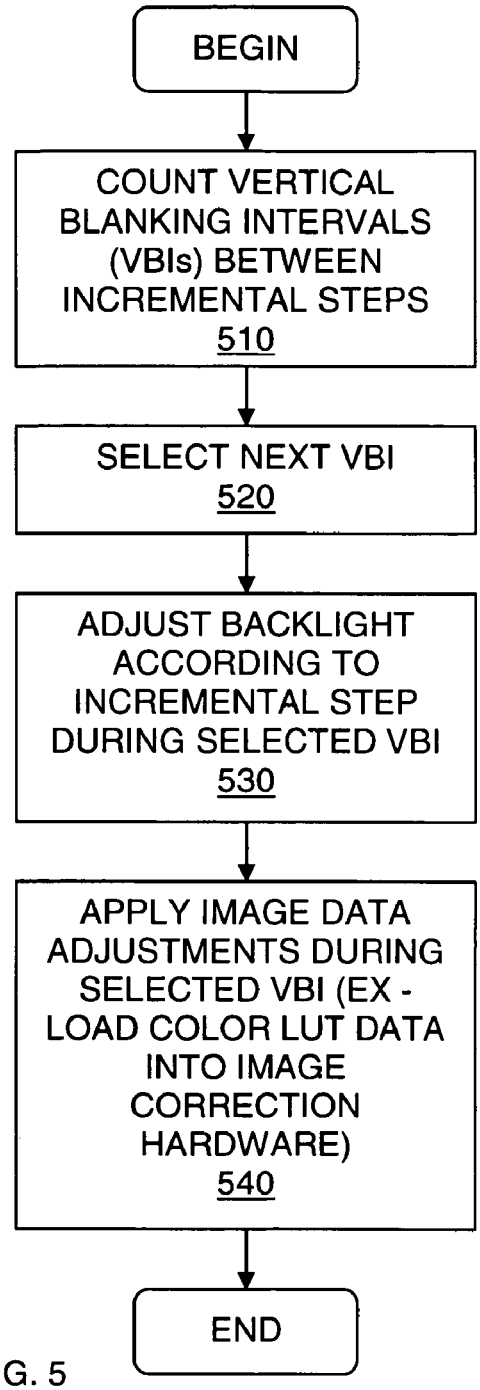
FIG. 5 illustrates one embodiment of the present invention for implementing an incremental adjustment.

FIG. 5 demonstrates one embodiment of the present invention for coordinating image data and backlight adjustments. For example, the process of FIG. 5 could be used for function 280 in FIG. 2.

If backlight and image data adjustments are not coordinated, image quality can suffer. For example, if a backlight is changed too long before or after a corresponding image adjustment, a user may perceive a brief flash or flicker. Fortunately, image data in many display devices include periodic vertical blanking intervals (VBIs). VBIs separate frames of image data and provide brief periods of time during which no data are applied to the display. The process illustrated in FIG. 5 can take advantage of VBIs to coordinate adjustments.

Since there is usually one VBI per frame, and since each incremental adjustment can define a number of frames per increment, the process can count the number of frames between increments at 510 by counting VBIs. At 520, after counting the frames between increments, the process can select the next VBI in the stream of image data. During this selected VBI, the process can adjust the backlight according to the incremental step at 530. And, still during the same VBI, the process can also apply the corresponding image data adjustment at 540. Since image data are usually not applied to a display during a VBI, the adjustments should not cause any image quality problems as they are made, and both adjustments should be available at the same time at the end of the VBI.

Most of the description up to this point has been primarily directed to improving image quality by phasing-in imperceptible, or less noticeable, adjustments. Embodiments of the present invention, however, can also phase-in adjustments for other purposes, such as power savings.

Figure 6:
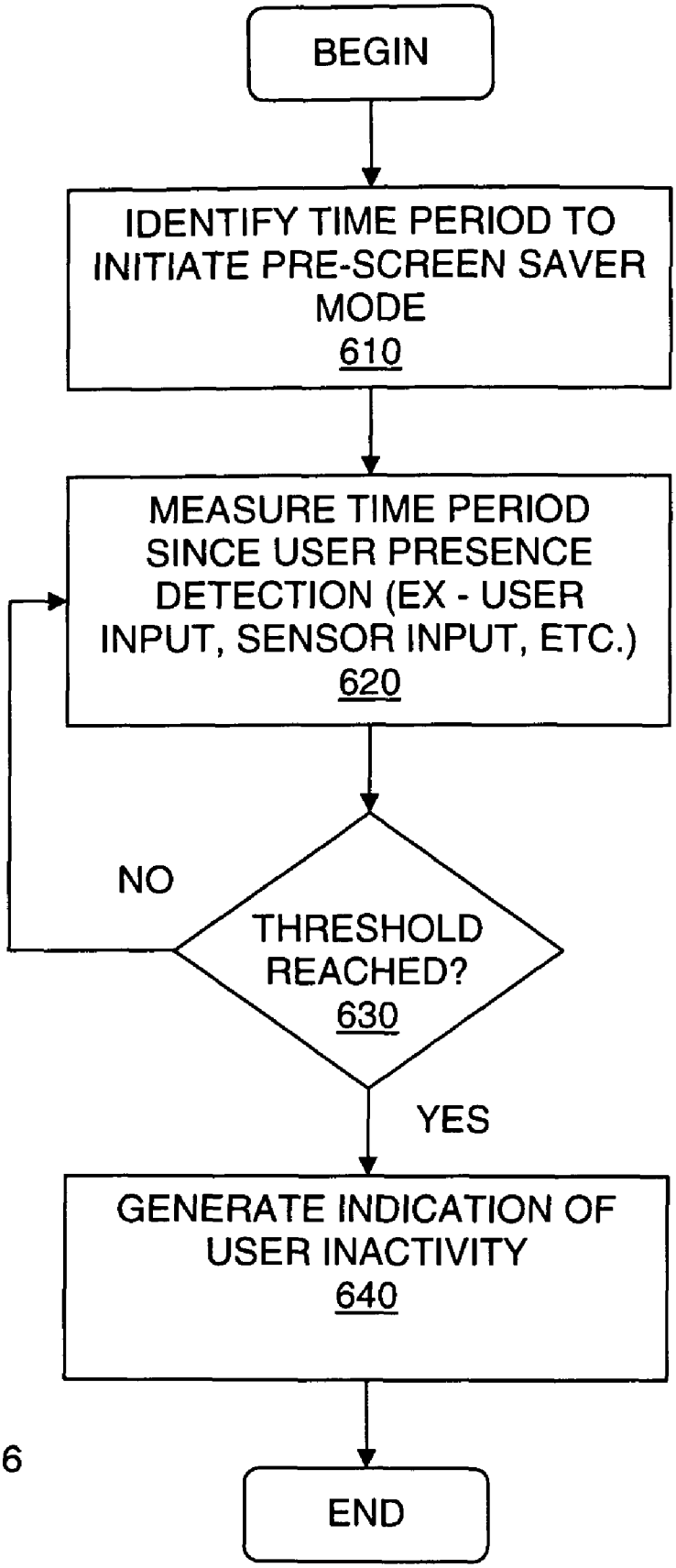
FIG. 6 illustrates one embodiment of the present invention for initiating a pre-screen saver.
Figure 7:
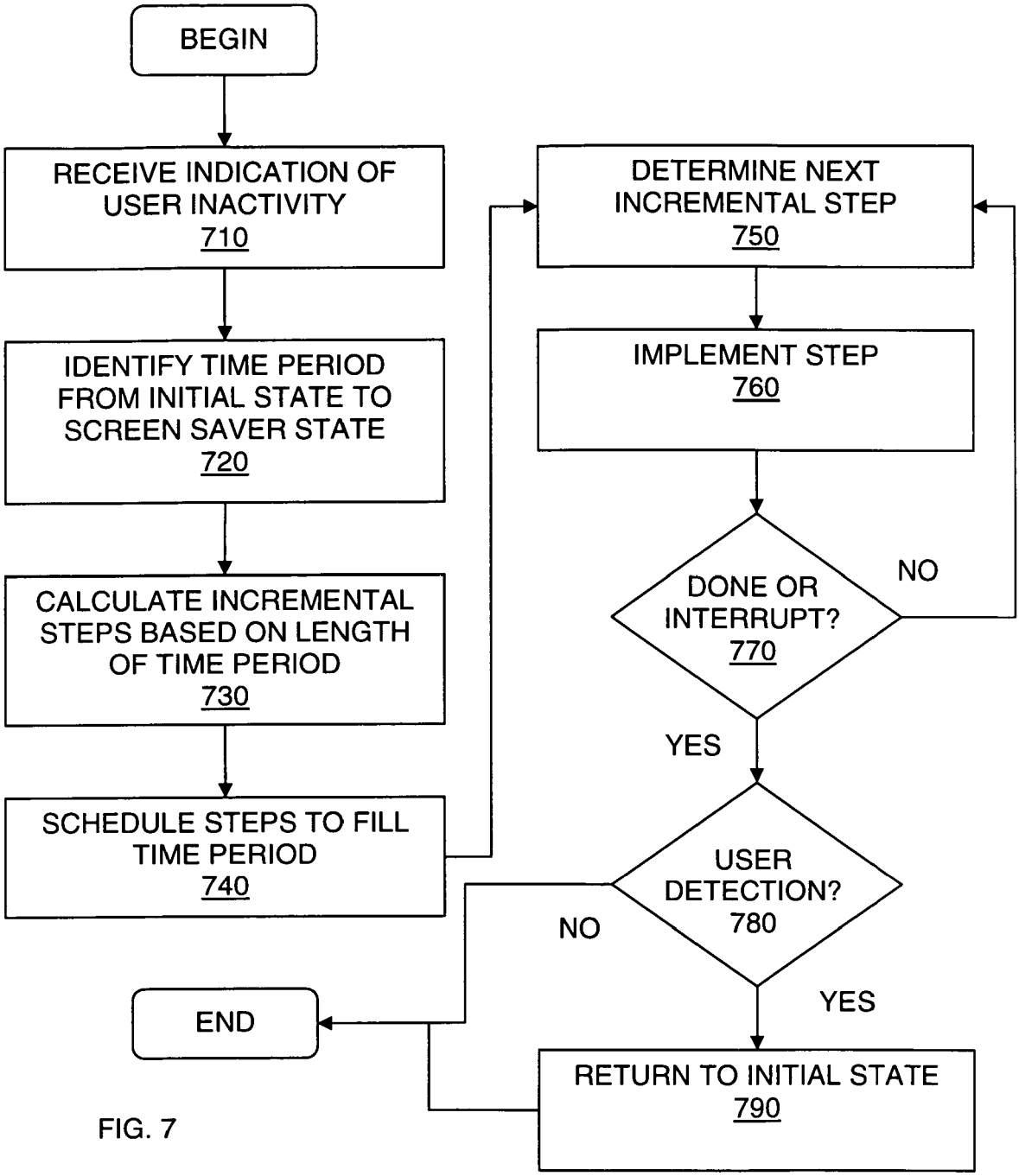
FIG. 7 illustrates one embodiment of a pre-screen saver.

For example, FIGS. 6 and 7 are directed to an embodiment of a power-saving pre-screen saver for which image quality may be a secondary concern. The target state for the pre-screen saver may be a blank screen, with the backlight turned completely off. Each incremental adjustment toward the blank screen may more aggressively degrade image quality in order to save incrementally more power. That is, for each incremental step, a larger portion of pixels in the display panel may be unable to support the reference brightness level as the backlight continues to get dimmer and dimmer. Depending on how quickly and aggressively adjustments are phased-in, a user may not initially notice any change in image quality. Even as the adjustments approach the target state and the image quality degrades, the image can remain readable right up to the point that the screen goes blank.

FIG. 6 demonstrates one embodiment of the present invention for determining when to initiate a pre-screen saver mode based on user presence detection. At 610, the process can identify a time period for initiating the pre-screen saver. For example, a manufacturer or user may set the time period to a certain number of minutes. The shorter the time period, the more power savings the pre-screen saver mode can provide.

At 620, the process can measure the amount of time since that last user presence detection. User presence can be detected in any number of ways. For example, keyboard or mouse input, optical or thermal sensor input, and the like, can all be used to detect the presence of a user.

At 630, the process can repeatedly compare the time measurement to the time threshold identified at 610 until the time threshold is reached. Then, the process can generate an indication of user inactively at 640.

FIG. 7 demonstrates one embodiment of a pre-screen saver process. At 710, the process can receive an indication of user inactivity, such as the indication generated at 640 in FIG. 6. At 720, the process can identify a time period for the pre-screen saver mode from the initial image-and-backlight state to the target state, which is the screen saver state in this case. Any number of techniques and/or criteria can be used to identify this time period. In one embodiment, the time period may be a fixed length. For example, the pre-screen saver mode may always last for 4 minutes, or some other length of time. A manufacturer or user may even have the option to manually set the time period.

In other embodiments, the time period may be calculated based on various factors, such as the battery level, the current state of the display, a fixed size and/or number of backlight adjustments that can be used, etc. For example, a DPST-enabled display may already be in a power saving mode at the initiation of the pre-screen saver, with the backlight dimmed from the default backlight setting and the image data adjusted accordingly. In which case, the pre-screen saver period may be shortened. As another example, the pre-screen saver period may be shortened if the battery level is lower.

At 730, the process can calculate a number of incremental steps between the initial state and the target state, based on the pre-screen saver time period. For example, in one embodiment, a process similar to the one described with respect to FIG. 3 could be used to evenly divide the backlight adjustments among the increments. However, unlike the process of FIG. 3, the adjustments would be applied more aggressively, allowing the image quality to degrade down to the target state, the idle screen saver state in this case. In other embodiments, rather than evenly distributing the adjustments, the adjustments could be weighted to one portion of the period or another. For example, once a sufficiently large portion of pixels can no longer support the reference brightness level at a particular incremental step, the image may be effectively unreadable. In which case, the next incremental step may as well jump directly to the target state and turn off the backlight. As another example, the incremental steps may get progressively larger and more aggressive so that image quality is impacted less at the beginning of the pre-screen saver mode. In yet another example, the first incremental step(s) may be relatively large in order to save significant power right away, followed by relatively small incremental steps to preserve some degree of readability, and ending with one relatively large incremental step.

At 740, the process can schedule the incremental steps to fill the time period. In one embodiment, the incremental steps may be evenly distributed over the time period. In other embodiments, like the size of the increments themselves, the incremental steps may be weighted to one portion of the time period or another. For example, the incremental steps may come at a faster rate near the beginning or end of the time period, and more slowly through the middle. In another example, the steps may come faster in the middle and more slowly at one end or the other.

After the increment steps have been calculated and scheduled in the illustrated embodiment, the process can begin applying them. At 750, the process can select a next incremental step and implement the step at 760. At 770, if the target state has not been reached, and the process has not been interrupted, it can repeatedly loop back through 750 and 760 to implement additional steps. At 780, if the process is interrupted due to a user detection, then the process can return the display to its initial state. Otherwise, if the process reaches the target state, the process can end.

In the illustrated embodiment, when there is a user presence detection at 780, the process can jump from its current state directly back to the initial state. In other embodiments, the process can return to the initial state by phasing-in incremental adjustments just like any other image adjustment. Returning to the initial state may phase-in much faster than the pre-screen savor.

FIGS. 1-7 illustrate a number of implementation specific details. Other embodiments may not include all the illustrated elements, may arrange the elements differently, may combine one or more of the elements, may include additional elements, and the like.

Furthermore, the various functions of the present invention can be implemented in any number of ways. For example, in one embodiment, generating image data adjustments based on backlight settings can comprise generating gamma corrections and loading the gamma corrections into a look-up table (LUT). Once the data is loaded in a LUT, the gamma corrections can be applied to image data as the image data is written to a display. Both generating and applying gamma corrections are often done in hardware, and the technology has existed for many years, although software implementations and new technologies can serve the same purposes.

Figure 8:
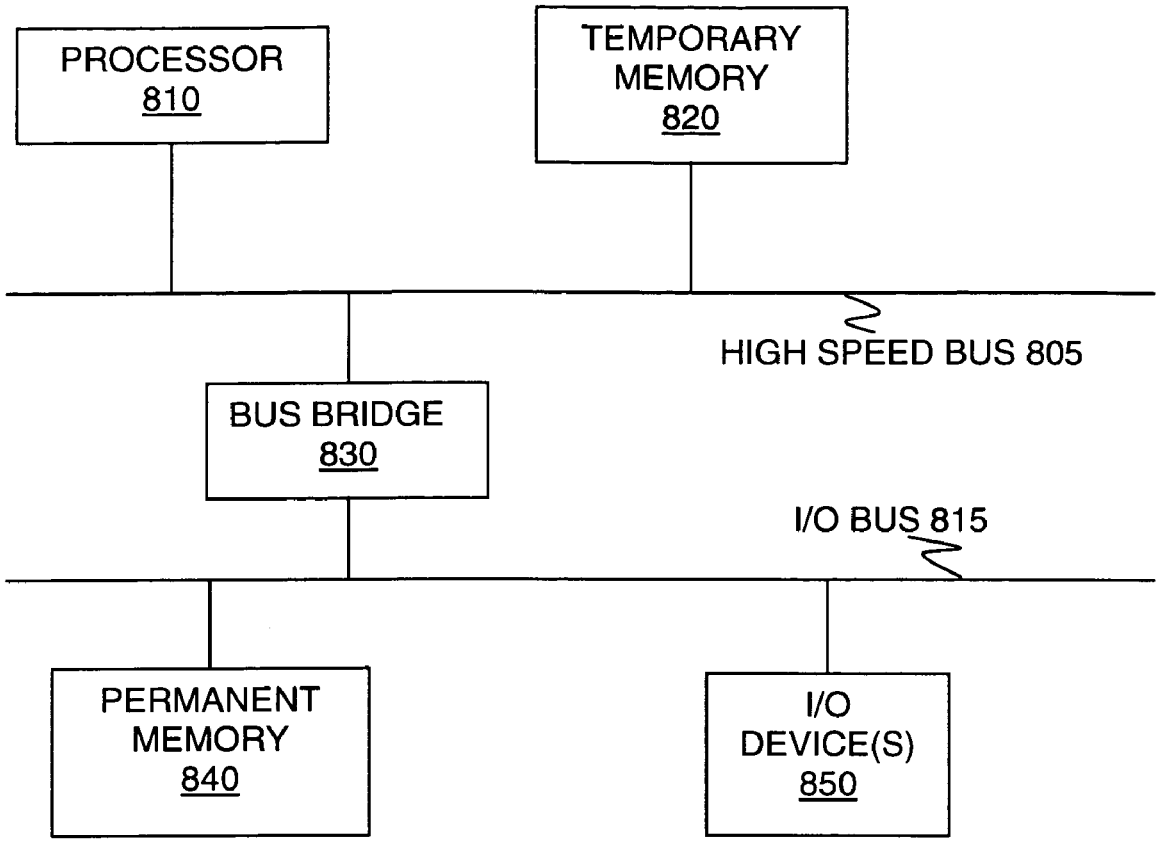
FIG. 8 illustrates one embodiment of a hardware system that can perform various functions of the present invention.

FIG. 8 illustrates one embodiment of a generic hardware system that can bring together the functions of various embodiments of the present invention. In the illustrated embodiment, the hardware system includes processor 810 coupled to high speed bus 805, which is coupled to input/output (I/O) bus 815 through bus bridge 830. Temporary memory 820 is coupled to bus 805. Permanent memory 840 is coupled to bus 815. I/O device(s) 850 is also coupled to bus 815. I/O device(s) 850 may include a display device, a keyboard, one or more external network interfaces, etc.

Certain embodiments may include additional components, may not require all of the above components, or may combine one or more components. For instance, temporary memory 820 may be on-chip with processor 810. Alternately, permanent memory 840 may be eliminated and temporary memory 820 may be replaced with an electrically erasable programmable read only memory (EEPROM), wherein software routines are executed in place from the EEPROM. Some implementations may employ a single bus, to which all of the components are coupled, while other implementations may include one or more additional buses and bus bridges to which various additional components can be coupled. Similarly, a variety of alternate internal networks could be used including, for instance, an internal network based on a high speed system bus with a memory controller hub and an I/O controller hub. Additional components may include additional processors, a CD ROM drive, additional memories, and other peripheral components known in the art.

Figure 9:
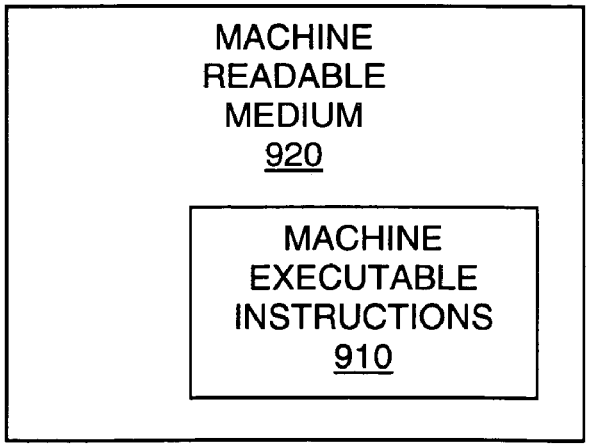
FIG. 9 illustrates one embodiment of a machine readable medium to store instructions that can implement various functions of the present invention.

Various functions of the present invention, as described above, can be implemented using one or more of these hardware systems. In one embodiment, the functions may be implemented as instructions or routines that can be executed by one or more execution units, such as processor 810, within the hardware system(s). As shown in FIG. 9, these machine executable instructions 910 can be stored using any machine readable storage medium 920, including internal memory, such as memories 820 and 840 in FIG. 8, as well as various external or remote memories, such as a hard drive, diskette, CD-ROM, magnetic tape, digital video or versatile disk (DVD), laser disk, Flash memory, a server on a network, etc. In one implementation, these software routines can be written in the C programming language. It is to be appreciated, however, that these routines may be implemented in any of a wide variety of programming languages.

In alternate embodiments, various functions of the present invention may be implemented in discrete hardware or firmware. For example, one or more application specific integrated circuits (ASICs) could be programmed with one or more of the above described functions. In another example, one or more functions of the present invention could be implemented in one or more ASICs on additional circuit boards and the circuit boards could be inserted into the computer(s) described above. In another example, one or more programmable gate arrays (PGAS) could be used to implement one or more functions of the present invention. In yet another example, a combination of hardware and software could be used to implement one or more functions of the present invention.

Thus, phasing-in adaptations to a display image is described. Whereas many alterations and modifications of the present invention will be comprehended by a person skilled in the art after having read the foregoing description, it is to be understood that the particular embodiments shown and described by way of illustration are in no way intended to be considered limiting. Therefore, references to details of particular embodiments are not intended to limit the scope of the claims.

What is claimed is:

1. A processor-implemented method comprising:

determining a next incremental step among a plurality of incremental steps from an initial image state of a display device to a target image state;

implementing the next incremental step;

identifying for the display device a minimum luma-per-second constraint, a maximum luma-per-increment constraint, and a refresh rate;

calculating a luma difference between the initial image state and the target image state;

calculating a target number of increments as the luma difference divided by the maximum luma-per-increment constraint;

rounding the target number of increments up to an integer to get an actual number of increments;

setting an actual increment size to the luma difference divided by the actual number of increments;

setting an actual number of frames-per-increment to the refresh rate times the maximum luma-per-increment constraint divided by the minimum luma-per-second constraint rounded up to a next integer if the minimum luma-per-second constraint divided by the refresh rate is less than the maximum luma-per-increment constraint;

setting the actual number of frames-per-increment to one if the minimum luma-per-second constraint divided by the refresh rate is greater than the maximum luma-per-second constraint; and defining one of the plurality of incremental steps for each of the actual number of increments, with each subsequent one of the plurality of incremental steps separated by the actual increment size and the actual number of frames-per-increment.

2. The processor-implemented method of claim 1 further comprising:

repeating the determining and implementing until the target image state is reached or the repeating is interrupted.

3. The processor-implemented method of claim 2 further comprising:

interrupting the repeating in response to a new target state;

setting the initial image state to a current state;

setting the target image state to the new target state; and re-initiating the determining and implementing.

4. The processor-implemented method of claim 1 further comprising:

identifying that an image adjustment from the initial image state to the target image state exceeds a threshold; and initiating the determining and implementing in response to the image adjustment exceeding the threshold.

5. The processor-implemented method of claim 1 wherein determining the next increment step among the plurality of incremental steps comprises determining a backlight adjustment.

6. The processor-implemented method of claim 5 wherein determining the next incremental step among the plurality of increment steps further comprises generating an image data adjustment based on the backlight adjustment.

7. The processor-implemented method of claim 1 wherein the next incremental step comprises a backlight adjustment and image data adjustments, and wherein implementing the next incremental step comprises:

identifying a particular vertical blanking interval for the display device;

adjusting a backlight of the display device with the backlight adjustment during the particular vertical blanking interval; and applying the image data adjustments during the particular vertical blanking interval.

8. The processor-implemented method of claim 7 wherein the image data adjustments comprise color look-up table data, and wherein applying the image data adjustments comprises:

loading the color look-up table data into image correction hardware for the display device.

9. The processor-implemented method of claim 2 wherein the target image state comprises a screen saver state, and wherein repeating the determining and implementing comprises a pre-screen saver mode for the display device, the method further comprising:

receiving an indication of user inactivity; and initiating the pre-screen saver mode in response to receiving the indication.

10. The processor-implemented method of claim 9 wherein receiving the indication comprises:

measuring a time period since a user presence detection; and generating the indication when the time period reaches a pre-screen saver threshold.

11. The processor-implemented method of claim 9 further comprising:

interrupting the pre-screen saver mode in response to a user presence detection; and returning to the initial image state.

12. A machine readable medium having stored thereon machine executable instructions that, when executed, implement a method comprising:

determining a next incremental step among a plurality of incremental steps from an initial image state of a display device to a target image state;

implementing the next incremental step;

identifying for the display device a minimum luma-per-second constraint, a maximum luma-per-increment constraint, and a refresh rate;

calculating a luma difference between the initial image state and the target image state;

calculating a target number of increments as the luma difference divided by the maximum luma-per-increment constraint;

rounding the target number of increments up to an integer to get an actual number of increments;

setting an actual increment size to the luma difference divided by the actual number of increments;

setting an actual number of frames-per-increment to the refresh rate times the maximum luma-per-increment constraint divided by the minimum luma-per-second constraint rounded up to a next integer if the minimum luma-per-second constraint divided by the refresh rate is less than the maximum luma-per-increment constraint;

setting the actual number of frames-per-increment to one if the minimum luma-per-second constraint divided by the refresh rate is greater than the maximum luma-per-second constraint; and defining one of the plurality of incremental steps for each of the actual number of increments, with each subsequent one of the plurality of incremental steps separated by the actual increment size and the actual number of frames-per-increment.

13. The machine readable medium of claim 12, the method further comprising:

repeating the determining and implementing until the target image state is reached or the repeating is interrupted.

14. The machine readable medium of claim 13, the method further comprising:

interrupting the repeating in response to a new target state;

setting the initial image state to a current state;

setting the target image state to the new target state; and re-initiating the determining and implementing.

15. The machine readable medium of claim 12 wherein determining the next incremental step among the plurality of incremental steps comprises determining a backlight adjustment.

16. The machine readable medium of claim 15 wherein determining the next incremental step among the plurality at increment steps further comprises generating an image data adjustment based on the backlight adjustment.

17. The machine readable medium of claim 12 wherein the next incremental step comprises a backlight adjustment and image data adjustments, and wherein implementing the next incremental step comprises:

identifying a particular vertical blanking interval for the display device;

adjusting a backlight of the display device with the backlight adjustment during the particular vertical blanking interval; and applying the image data adjustments during the particular vertical blanking interval.

18. The machine readable medium of claim 13 wherein the target image state comprises a screen saver state, and wherein repeating the determining and implementing comprises a pre-screen saver mode for the display device, the method further comprising:

receiving an indication of user inactivity; and initiating the pre-screen saver mode in response to receiving the indication.

19. The machine readable medium of claim 18, the method further comprising:

interrupting the pre-screen saver mode in response to a user presence detection; and returning to the initial image state.

20. A system comprising:

a notebook computer;

a display device on the notebook computer; and phase-in logic, said phase-in logic to determine a next incremental step among a plurality of incremental steps from an initial image state of a display device to a target image state;

implement the next incremental step;

identity for the display device a minimum luma-per-second constraint, a maximum luma-per-increment constraint, and a refresh rate;

calculate a luma difference between the initial image state and the target image state;

calculate a target number of increments as the luma difference divided by the maximum luma-per-increment constraint;

round the target number of increments up to an integer to get an actual number of increments;

set an actual increment size to the luma difference divided by the actual number of increments;

set an actual number of frames-per-increment to the refresh rate times the maximum luma-per-increment constraint divided by the minimum luma-per-second constraint rounded up to a next integer if the minimum luma-per-second constraint divided by the refresh rate is less than the maximum luma-per-increment constraint;

set the actual number of frames-per-increment to one if the minimum luma-per-second constraint divided by the refresh rate is greater than the maximum luma-per-second constraint; and define one of the plurality of incremental steps for each of the actual number of increments, with each subsequent one of the plurality of incremental steps separated by the actual increment size and the actual number of frames-per-increment.

21. The system of claim 20, the phase-in logic further to:

repeatedly determine and implement next incremental steps from the plurality of incremental steps until the target image state is reached or an interrupt occurs.

22. The system of claim 21, the phase-in logic further to:

interrupt the repeating in response to a new target state;

set the initial image state to a current state;

set the target image state to the new target state; and re-initiate the determining and implementing.

23. The system of claim 20 wherein the next incremental step comprises a backlight adjustment.

24. The system of claim 23 wherein the next incremental step further comprises an image data adjustment based on the backlight adjustment.

25. The system of claim 21 wherein the target image state comprises a screen saver state, and wherein repeatedly determining and implementing next incremental steps comprises a pre-screen saver mode for the display device, the phase-in logic further to:

receive an indication of user inactivity; and initiate the pre-screen saver mode in response to receiving the indication.

* * * * *